US006913296B2

(12) United States Patent
Bassi

(10) Patent No.: US 6,913,296 B2
(45) Date of Patent: Jul. 5, 2005

(54) CLOSING DEVICE FOR THE DOOR OF AN ELECTRIC HOUSEHOLD APPLIANCE, IN PARTICULAR A DISHWASHER

(75) Inventor: Alberto Bassi, Turin (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 10/377,108

(22) Filed: Mar. 3, 2003

(65) Prior Publication Data

US 2003/0218339 A1 Nov. 27, 2003

(30) Foreign Application Priority Data

Mar. 5, 2002 (IT) ..... TO2002A0182

(51) Int. Cl.[7] ..... E05C 19/10
(52) U.S. Cl. ..... 292/122; 292/DIG. 69
(58) Field of Search ..... 292/DIG. 69, 121, 292/122, 126, 223, 226

(56) References Cited

U.S. PATENT DOCUMENTS

| | | | | |
|---|---|---|---|---|
| 3,260,813 A | | 7/1966 | Dargene | |
| 3,854,762 A | * | 12/1974 | Spiegel et al. | 292/197 |
| 4,707,003 A | * | 11/1987 | Read | 292/45 |
| 4,754,250 A | * | 6/1988 | Duin | 336/65 |
| 4,782,673 A | * | 11/1988 | Castelli et al. | 70/72 |
| 4,907,831 A | * | 3/1990 | Di Giusto | 292/216 |
| 5,052,200 A | * | 10/1991 | Claar et al. | 70/123 |
| 5,062,668 A | * | 11/1991 | Onderka et al. | 292/25 |
| 5,477,030 A | * | 12/1995 | Buckshaw et al. | 219/413 |
| 6,302,098 B1 | * | 10/2001 | Smith | 126/197 |
| 6,315,336 B1 | * | 11/2001 | Swartzell | 292/201 |
| 6,402,208 B1 | * | 6/2002 | Shimizu | 292/123 |

FOREIGN PATENT DOCUMENTS

| | | |
|---|---|---|
| DE | 2756366 | 6/1979 |
| DE | 19540843 | 5/1997 |
| EP | 0727178 | 8/1996 |
| GB | 1396254 | 6/1975 |
| GB | 1464070 | 2/1977 |

* cited by examiner

*Primary Examiner*—Gary Estremsky
(74) *Attorney, Agent, or Firm*—Lowe Hauptman & Berner, LLP

(57) ABSTRACT

A closing device for the door of an electronic household appliance has a latch fitted to the door to rotate, in opposition to an elastic element, about an axis of rotation, and to cooperate with a catch fixed to the electric household appliance. The latch activates a switch device disabling operation of the electric household appliance when the door is open. The latch has, in an eccentric position with respect to its axis of rotation, a first constraint member for the elastic element, and a second constraint member which is fitted integrally to the door. The elastic element is extensible along a work axis connecting the first and second constraint members and lies at all times in a plane perpendicular to the plane containing the axis of rotation of the latch. The latch selectively assumes, by virtue of the elastic element, a first position and a second position, in which it does not directly activate and, respectively, does directly activate the switch device, and in which the work axis is located above and, respectively, below the axis of rotation of the latch.

7 Claims, 2 Drawing Sheets

CLOSING DEVICE FOR THE DOOR OF AN ELECTRIC HOUSEHOLD APPLIANCE, IN PARTICULAR A DISHWASHER

The present invention relates to a closing device for the door of an electric household appliance, in particular a dishwasher, and of the type controlling an operating switch of the appliance, in particular a known switch disabling operation of the appliance when the door is open.

BACKGROUND OF THE INVENTION

As described, for example, in British Patent n. 1464070, dishwasher doors are known to feature a rotating latch loaded by a return spring, and which, when the door is closed, engages a catch integral with the appliance casing; and, when the user pulls on the door handle, the latch rotates about its hinge point to disengage the catch. To stop the dishwater (in particular, the water pump) automatically, and so prevent injury to the user, when the door is opened, British Patent n. 1464070 features an independent control lever, which must be operated by the user to obtain access to the door handle, and which acts on a switch co-operating with the dishwasher pump supply circuit. To open the door, the user must use both hands, which, though effective in terms of user safety, is obviously awkward.

Devices are also known in which the latch is connected directly or indirectly to the lever controlling the dishwasher supply circuit switch; and, when the door is opened, rotation of the latch itself also moves the control lever to act on the switch. A common drawback of known devices of this type, however, lies in the delay between the latch movement and the control lever acting on the switch, so that the dishwasher is not stopped until the door has actually already started to open, which is obviously undesirable. To eliminate or minimize this drawback, known devices (as, for example, in European Patent Application EP-A-0727178) are expensive, bulky, and complicated to make and assemble.

SUMMARY OF THE INVENTION

It is an object of the present invention to provide a closing device for the door of an electric household appliance, designed to eliminate the aforementioned drawbacks. More specifically, it is an object of the invention to provide a device ensuring a high degree of user safety, and which at the same time is practical to use, cheap and easy to produce, and compact by comprising, for example, a small number of component parts.

According to the present invention, there is provided a closing device for the door of an electric household appliance, in particular a dishwasher, and comprising a latch, which is fitted to said door to rotate, in opposition to elastic means, about an axis of rotation, and to cooperate with a catch fixed to the electric household appliance, and activates a switch device disabling operation of the electric household appliance when the door is open; characterized in that said latch comprises, in an eccentric position with respect to its axis of rotation, a first constraint member for said elastic means, a second constraint member for which is fitted integrally to the door; said elastic means being extensible along a work axis connecting said first and said second constraint member and lying at all times in a plane perpendicular to a plane containing the axis of rotation of the latch; and the latch selectively assuming, by virtue of the action of said elastic means, a first and a second position, in which it does not directly activate and, respectively, does directly activate a contact element of the switch device, and in which said work axis of the elastic means is located on opposite sides of said axis of rotation of the latch.

It is therefore the latch, as it is rotated to open the door, which directly activates the switch disabling operation of the appliance when the door is opened, thus eliminating the delays caused by the mechanisms of known devices. Moreover, eliminating the control lever, made possible by the particular way in which the elastic means are assembled, makes the device much more simple and compact by reducing the number of component parts.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
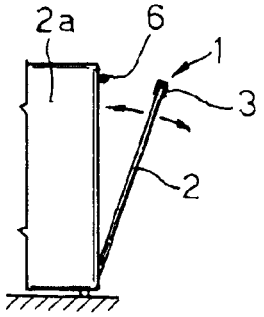
FIG. 1 shows a schematic, small-scale side view of an electric household appliance with the door open.

With reference to FIGS. 1 to 5, number 1 indicates as a whole a closing device for a door 2 of an electric household appliance 2*a*, in particular a dishwasher. Door 2, which is known and not described or illustrated in detail for the sake of simplicity, is fitted in known manner—in the example shown, at the top edge—with a supporting member 3 for device 1. Supporting member 3 (hereinafter referred to simply as "support 3") includes a partly recessed seat 4 for housing a latch 5 fitted to support 3 to rotate about an axis of rotation R (and therefore fitted integrally to door 2 via support 3 and rotating with respect to door 2) so as to cooperate with a known catch 6 fixed to a known casing (not shown for simplicity) of the appliance.

Figure 4:
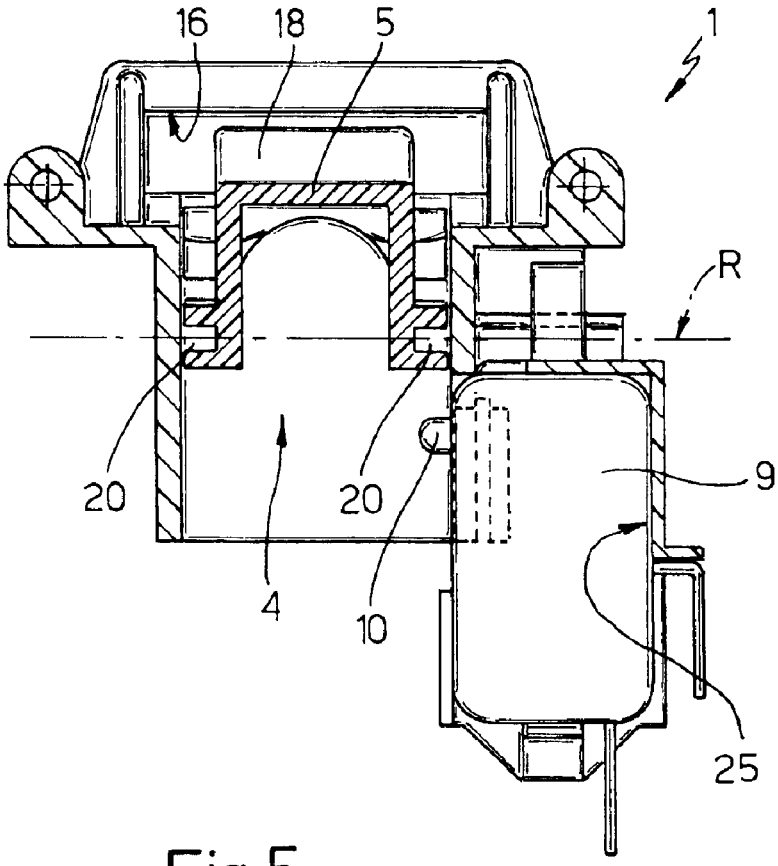
FIGS. 4 and 5 show sections along lines IV—IV and V—V of the device in the FIGS. 2 and 3 configurations respectively.

In addition to support 3 and latch 5, device 1 also comprises elastic contrasting means 7 for opposing rotation of latch 5; and a known switch device 9 for disabling operation of appliance 2*a* when door 2 is open. For example, switch device 9 acts on a circuit of the appliance (e.g. a water pump supply circuit), which is cut off, thus stopping the appliance, when a contact element 10 is not activated (normally-closed switch device), e.g. is not pressed inside a seat 11 (FIG. 5), but projects from the body of switch device 9 (FIGS. 2, 4).

According to the invention, latch 5 comprises, in an eccentric position with respect to its axis of rotation R, a first constraint member 12 for elastic contrasting means 7, which is defined by a straightforward cylindrical pin projecting axially (i.e. parallel to axis R) from a lateral face of latch 5. According to a first characteristic of the invention, a second constraint member 14 for elastic means 7, also defined by a straightforward cylindrical pin, is fitted integrally to door 2 by being formed integrally in one piece with support 3.

Elastic means 7 are defined by a straightforward helical spring having an axis of symmetry D, along which spring 7 is extensible, and which therefore constitutes the work axis of elastic means 7. According to the invention, latch 5 and pins 12, 14 are so arranged that axis D always connects pins 12, 14 along a straight line lying at all times in a plane perpendicular to a plane containing the axis of rotation R of latch 5—in the example shown, lying at all times in a plane parallel to the drawing plane of FIG. 2, while axis R is perpendicular to the drawing plane of FIG. 2.

Figure 2:
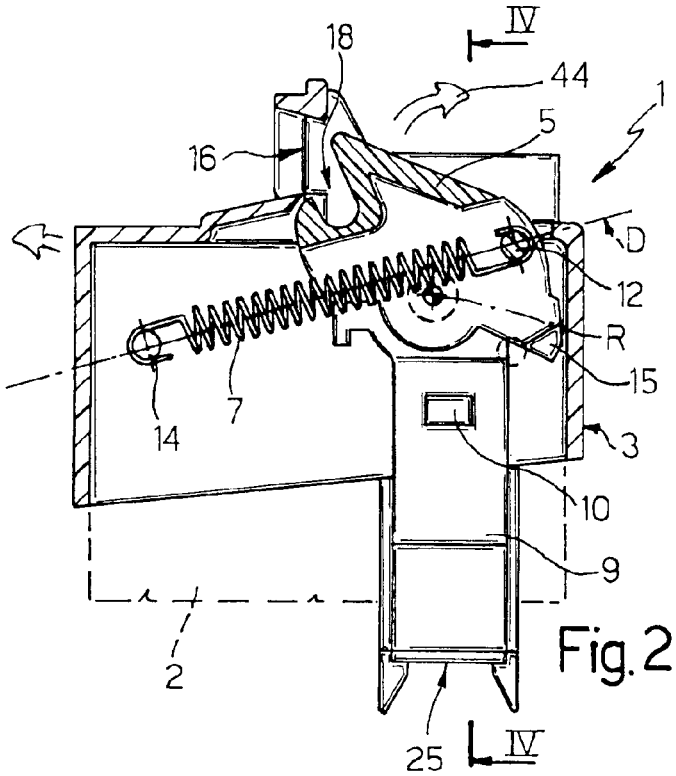
FIG. 2 shows a schematic section of a closing device, in accordance with the invention, for the door of the FIG. 1 electric household appliance and shown in a first operating position corresponding to the open-door condition.
Figure 3:
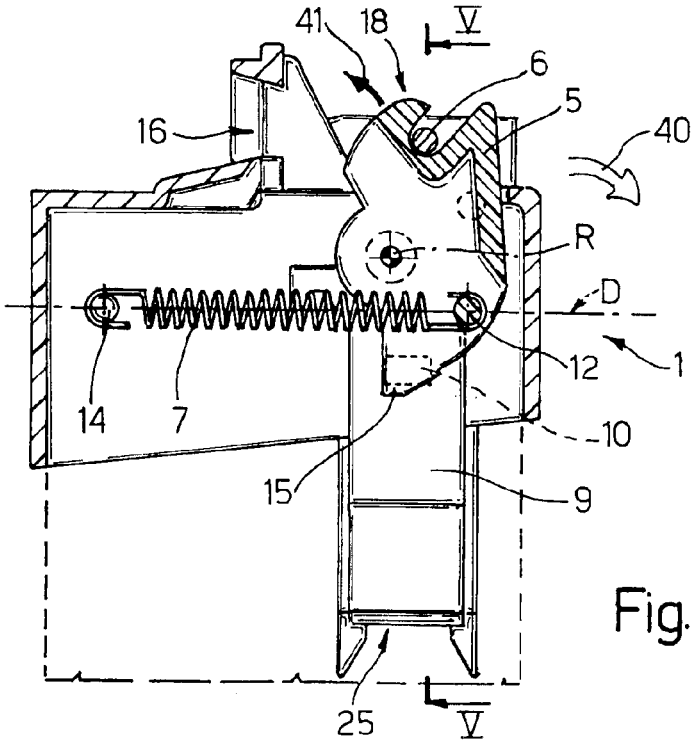
FIG. 3 shows a schematic section of the FIG. 2 device in a second operating position corresponding to the closed-door condition.

As shown in FIGS. 2 and 3, latch 5 is fitted in rotary manner to support 3 so as to selectively assume, by virtue of the action of spring 7, a first and a second position, in which it does not activate (FIGS. 2 and 4) and, respectively, does activate (FIGS. 3 and 5) contact element 10 of switch device 9, and in which the work axis D of spring 7 is located on opposite sides of axis of rotation R of latch 5.

According to another fundamental aspect of the invention, latch 5, as it rotates about axis R, acts directly on contact element 10. In the example shown, latch 5 has an eccentric, radially projecting appendix 15, which acts on and causes contact element 10 to withdraw inside seat 11 when latch 5 is in said second position shown in FIGS. 3 and 5.

In the non-limiting embodiment shown, pin 14 is carried integrally by support 3, on the opposite side to latch 5 and on the side of support 3 facing catch 6 in use. Seat 4 defined for latch 5 by support 3 is defined, on the side facing catch 6 in use, by a through opening 16, through which catch 6 moves in use to engage/release a hook-shaped end 18 of latch 5.

Latch 5 is mounted idly on two coaxial pins 20 (FIGS. 4, 5)—e.g. integral with support 3 and defining axis of rotation R—with the hook-shaped end 18 located on the same side of work axis D in both said first and second positions.

Obviously, a dual solution to the one shown is also possible, in which pins 20 are integral with latch 5 and mounted idly inside coaxial seats formed in support 3.

End 18 is located substantially on the opposite side of axis R to appendix 15, and, consequently, support 3 supports switch device 9 on the opposite side to end 18 and axially to the side of latch 5, i.e. shifted laterally with respect to latch 5, in a direction parallel to axis of rotation R of latch 5.

Spring 7 has opposite hook-shaped ends engaging pins 12, 14, which allow the ends of spring 7 to rotate with respect to them, and therefore spring 7 to rotate with respect to support 3, so as to vary the orientation of axis D of spring 7 with respect to axis R in the two positions of latch 5 shown in FIGS. 2 and 3.

Support 3 being fitted, in the example shown, to the top edge of door 2, axis D of spring 7 in said first and second position is located above and, respectively, below axis of rotation R of latch 5, so that use may be made of a standard switch device 9, which is clicked inside a seat 25 formed in an appropriate position on support 3.

Device 1 operates as follows.

Figure 5:
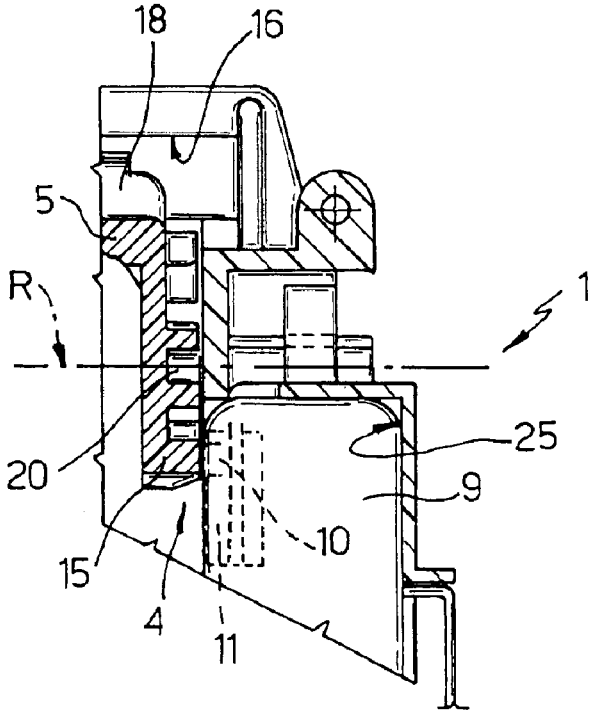

When the door is closed, device 1 as a whole is in a first position of stable equilibrium shown in FIGS. 3 and 5, in which latch 5 engages catch 6 and is held in position by spring 7 fitted, always slightly preloaded, between pins 12, 14 (in the example shown, by using a spring 7 shorter, when undeformed, than the distance in a straight line between pins 12 and 14). Work axis D of spring 7 is located below axis of rotation R, i.e. on the opposite side of axis R to end 18 engaging catch 6, and so keeps end 18 resting against catch 6; and appendix 15 acts on and keeps contact element 10 withdrawn inside seat 11, so that switch device 9 enables operation of the appliance.

To open door 2, the user pulls it in the direction of arrow 40 (FIG. 3) so that it rotates with respect to the base of the appliance; as a result, catch 6 presses against end 18 to force latch 5 to rotate in the direction of arrow 41 about axis R and in opposition to spring 7; and the anticlockwise rotation of latch 5 moves eccentric pin 12 on latch 5 away from pin 14, thus elastically stretching spring 7.

At the same time, the relative rotation between pin 14 (fixed to support 3) and latch 5 (fitted idly to support 3) rotates work axis D anticlockwise and upwards towards axis R; and appendix 15 immediately releases contact element 10 which, by means of known elastic means (not shown) inside switch device 9, is expelled from seat 11, thus cutting off electrical supply to appliance 2*a*.

As door 2 is opened further, catch 6 is withdrawn from seat 4 in support 3 through opening 16 as axis D intersects and just passes axis R; and latch 5, with the aid of spring 7, gets over the unstable dead-center position defined by the above condition, and is rotated further anticlockwise by spring 7 into the FIG. 2 position, in which spring 7 has reassumed its original length, but with axis D above axis R, so that latch 5 is retained stably in that position.

When door 2 is closed by the user, catch 6 is inserted inside seat 4 through opening 16, and pushes against end 18 to rotate latch 5, in the direction of arrow 44 (FIG. 2), back into the FIG. 3 position, in the opposite sequence to that described above, so that contact element 10 of switch device 9 is restored to the enabling position.

What is claimed is:

1. A closing device for a door of an electric household appliance, said closing device comprising:

an elastic element;

a latch, which is adapted to be fitted to the door to rotate, in opposition to said elastic element, about an axis of rotation, and adapted to cooperate with a catch fixed to the electric household appliance; and a switch device adapted to be activated by said latch for disabling operation of the electric household appliance when the door is open;

said latch comprising, in an eccentric position with respect to the axis of rotation, a first constraint member for said elastic element, and a second constraint member adapted to be fitted to the door;

said elastic element being extensible along a work axis connecting said first and second constraint members and lying at all times in a plane perpendicular to a plane containing the axis of rotation of said latch; and said latch selectively assuming, by virtue of the action of said elastic element, a first position and a second position, in which said latch does not-directly activate and, respectively, does directly activate a contact element of said switch device, and in which said work axis of said elastic element is located on opposite sides of said axis of rotation of said latch;

wherein said latch further comprises a hook-shaped end adapted to directly engage with the catch of the electric household appliance when the door is closed, and said hook-shaped end of said latch is located on the same side of said work axis in both said first and second positions;

said closing device further comprises a supporting member fittable to the door and supporting said latch, said elastic element, and said switch device;

said second constraint member is fitted to said supporting member;

said latch is fitted in rotary manner to said supporting member, and is housed inside a seat defined, on the side facing the catch in use, by a through opening through which the catch moves to engage/release said hook-shaped end of said latch; and said latch is mounted idly on two coaxial pins defining said axis of rotation.

2. The device as claimed in claim 1, wherein said supporting member supports said switch device on the opposite side to said hook-shaped end of said latch and axially to the side of said latch with respect to the axis of rotation of said latch.

3. The device as claimed in claim 1, wherein said elastic element is defined by a helical spring having said work axis as an axis of symmetry thereof, and having hook-shaped opposite ends engaging said first and second constraint members.

4. The device as claimed in claim 3, wherein said first and second constraint members permit relative rotation between themselves and said elastic element.

5. The device as claimed in claim 4, wherein said first and second constraint members are defined by respective cylindrical pins.

6. The device as claimed in claim 1, wherein said supporting member is fittable to a top edge of the door;

in said first and said second positions, said work axis of said elastic element being located above and, respectively, below said axis of rotation of said latch.

7. The device as claimed in claim 1, wherein said latch comprises an eccentric, radially projecting appendix for activating said contact element of said switch device in said second position;

said switch device being adapted to disable operation of the electric household appliance when said contact element is not activated.

* * * * *